US009864288B2

(12) United States Patent
Takahashi et al.

(10) Patent No.: US 9,864,288 B2
(45) Date of Patent: Jan. 9, 2018

(54) TONER SET, IMAGE FORMING APPARATUS, AND IMAGE FORMING METHOD

(71) Applicant: FUJI XEROX CO., LTD., Tokyo (JP)

(72) Inventors: Shotaro Takahashi, Kanagawa (JP); Atsushi Sugitate, Kanagawa (JP); Masaru Takahashi, Kanagawa (JP); Sakiko Hirai, Kanagawa (JP); Satomi Hara, Kanagawa (JP)

(73) Assignee: FUJI XEROX CO., LTD., Tokyo (JP)

( * ) Notice: Subject to any disclaimer, the term of this patent is extended or adjusted under 35 U.S.C. 154(b) by 160 days.

(21) Appl. No.: 14/790,590

(22) Filed: Jul. 2, 2015

(65) Prior Publication Data

US 2016/0195829 A1 Jul. 7, 2016

(30) Foreign Application Priority Data

Jan. 5, 2015 (JP) ..... 2015-000444

(51) Int. Cl.

| | |
|---|---|
| ***G03G 9/09*** | (2006.01) |
| ***G03G 9/08*** | (2006.01) |
| ***G03G 13/01*** | (2006.01) |

(52) U.S. Cl.

CPC ..... *G03G 9/0926* (2013.01); *G03G 9/0821* (2013.01); *G03G 9/0825* (2013.01); *G03G 9/0902* (2013.01); *G03G 13/013* (2013.01)

(58) Field of Classification Search

CPC ... G03G 9/0926; G03G 9/0902; G03G 9/0821
USPC ..... 430/107.1, 45.51, 45.53
See application file for complete search history.

(56) References Cited

U.S. PATENT DOCUMENTS

| | | | | |
|---|---|---|---|---|
| 8,021,814 | B2 * | 9/2011 | Hagi | G03G 9/081 430/108.8 |
| 2011/0318063 | A1 * | 12/2011 | Takahashi | G03G 9/0819 399/262 |
| 2014/0193751 | A1 * | 7/2014 | Sugitate | G03G 15/6585 430/107.1 |
| 2016/0282738 | A1 * | 9/2016 | Kuwabara | G03G 9/0902 |

FOREIGN PATENT DOCUMENTS

| | | | |
|---|---|---|---|
| JP | 2011-203548 | A | 10/2011 |
| JP | 2016-186519 | A * | 10/2016 |

OTHER PUBLICATIONS

ESPACENET machine-assisted English-language translation of Japanese Patent 2016-186519 A (pub. Oct. 2016).*

* cited by examiner

*Primary Examiner* — Janis L Dote
(74) *Attorney, Agent, or Firm* — Oliff PLC

(57) ABSTRACT

A toner set includes a brilliant toner including a brilliant pigment; and a chromatic toner including a coloring agent that is different from the brilliant pigment, wherein the toner set satisfies the following expression:

$$1.2 \leq Q1/Q2 \leq 5.0$$

wherein Q1 represents an endothermic quantity of the brilliant toner and Q2 represents an endothermic quantity of the chromatic toner.

11 Claims, 2 Drawing Sheets

TONER SET, IMAGE FORMING APPARATUS, AND IMAGE FORMING METHOD

CROSS-REFERENCE TO RELATED APPLICATIONS

This application is based on and claims priority under 35 USC 119 from Japanese Patent Application No. 2015-000444 filed Jan. 5, 2015.

BACKGROUND

1. Technical Field

The present invention relates to a toner set, an image forming apparatus, and an image forming method.

2. Related Art

In order to form an image having brightness such as metal gloss, a brilliant toner has been used.

SUMMARY

According to an aspect of the invention, there is provided a toner set including:

a brilliant toner including a brilliant pigment; and a chromatic toner including a coloring agent that is different from the brilliant pigment, and the toner set satisfies the following expression:

$$1.2 \leq Q1/Q2 \leq 5.0$$

wherein Q1 represents an endothermic quantity of the brilliant toner, and Q2 represents an endothermic quantity of the chromatic toner.

BRIEF DESCRIPTION OF THE DRAWINGS

Exemplary embodiments of the present invention will be described in detail based on the following figures, wherein.

DETAILED DESCRIPTION

Figure 1:
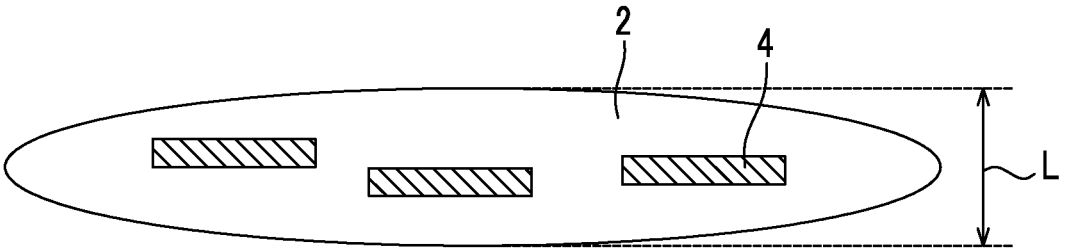
FIG. 1 is a sectional view schematically illustrating an example of brilliant toner particles of this exemplary embodiment.

Hereinafter, an exemplary embodiment of a toner set, an image forming apparatus, and an image forming method of the invention will be described in detail.

Toner Set

A toner set of this exemplary embodiment includes a brilliant toner including a brilliant pigment, and a chromatic toner including a coloring agent, and an endothermic quantity of the brilliant toner satisfies a relationship in which the endothermic quantity of the brilliant toner is from 1.2 times to 5 times an endothermic quantity of the chromatic toner.

In this exemplary embodiment, as the chromatic toner, one type of the chromatic toner may be used, or two or more types of the chromatic toners which may express colors different from each other may be used. In a case where two or more types of the chromatic toners are used, when the endothermic quantities of the respective chromatic toners are different from each other, it is necessary that the endothermic quantity of all of the chromatic toners and the endothermic quantity of the brilliant toner satisfy the relationship described above.

By using the toner set in this exemplary embodiment, gloss unevenness is prevented from occurring at the time of collectively fixing the brilliant toner and the chromatic toner. The reason is not obvious, and it is presumed as follows.

As the brilliant pigment included in the brilliant toner, a flake metal pigment having a large diameter and a large aspect ratio is usually used. However, at the time of fixing the brilliant toner including a brilliant pigment, thermal conductivity of the brilliant pigment is high, and thus hot offset easily occurs compared to the chromatic toner which includes an organic pigment or an inorganic pigment as the coloring agent. In addition, at the time of fixing the brilliant toner including the brilliant pigment, even when a release agent is contained in the brilliant toner, the flake metal pigment having a large diameter and a large aspect ratio may inhibit the release agent from being exuded from the inside of the toner to the outside. For this reason, the brilliant toner easily causes the hot offset. Due to the hot offset, gloss unevenness may occur on a fixed image of the toner.

In the toner set of this exemplary embodiment, the endothermic quantity of the brilliant toner is from 1.2 times to 5 times the endothermic quantity of the chromatic toner. Accordingly, it is presumed that a heat quantity applied to the brilliant toner at the time of fixing is relaxed, and the occurrence of the hot offset is prevented in a system in which the chromatic toner and the brilliant toner are collectively fixed, and thus an occurrence of gloss unevenness on a color metallic image is prevented.

Furthermore, "brilliant" in this exemplary embodiment indicates that when an image formed by the brilliant toner of this exemplary embodiment is in visually contact, the image has brightness such as metal gloss.

As the chromatic toner which is able to be included in the toner set of this exemplary embodiment, a magenta toner, a cyan toner, a yellow toner, a black toner, a red toner, a green toner, a blue toner, an orange toner, a violet toner, and the like which are known toners are included.

Hereinafter, the brilliant toner of this exemplary embodiment configuring the toner set of this exemplary embodiment will be described.

When a solid image is formed, in the brilliant toner of this exemplary embodiment, it is preferable that a ratio (A/B) of a reflectance A at a light receiving angle of +30° which is measured by a goniophotometer at the time of irradiating the image with incident light having an incident angle of −45° to a reflectance B at a light receiving angle of −30° is from 2 to 100.

The ratio (A/B) of greater than or equal to 2 indicates that the reflection on a side (an angle+side) opposite to the incident side is greater than the reflection on a side (an angle−side) on which the incident light is incident, that is, diffused reflection of the incident light is prevented. In a case where the diffused reflection occurs in which the incident light is reflected towards various directions, when the reflected light is confirmed by visual contact, the color is dull. For this reason, in a case where the ratio (A/B) is less than 2, even when the reflected light is viewed, the gloss is not able to be confirmed, and brilliance may be deteriorated.

In contrast, when the ratio (A/B) is greater than 100, a viewing angle at which the reflected light is able to be viewed is excessively narrowed, and a regular reflected light component increases, and thus the color may be blackish according to an observing angle. In addition, it is difficult to manufacture the brilliant toner in which the ratio (A/B) is greater than 100.

Furthermore, the ratio (A/B) described above is preferably from 50 to 100, is more preferably from 60 to 90, and is particularly preferably from 70 to 80.

Measurement of Ratio (A/B) Using Goniophotometer

Herein, first the angle of incidence and the light receiving angle will be described. When measuring the ratio with a goniophotometer in the exemplary embodiment, the angle of incidence is set to −45°, and this is because high measurement sensitivity is obtained with respect to an image with a wide range of glossiness.

In addition, the light receiving angle is set to −30° and to +30° because the measurement sensitivity is highest when evaluating an image with a brilliant property and an image with no brilliant property.

Next, a measurement method of the ratio (A/B) will be described.

In the exemplary embodiment, when measuring the ratio (A/B), first, a "solid image" is formed with the following method. A developing device of a DOCUCENTRE-III C7600 manufactured by Fuji Xerox Co., Ltd. is filled with a developer that is a sample, and a solid image having a toner applied amount of 4.5 g/m$^2$ is formed on a recording sheet (OK TOPCOAT+, manufactured by Oji Paper Co., Ltd.) at a fixing temperature of 190° C. and a fixing pressure of 4.0 kg/cm$^2$. The "solid image" indicates an image having a printing rate of 100%.

An image part of the formed solid image is irradiated with the incident light at an angle of incidence of −45° with respect to the solid image, and a reflectance A at a light receiving angle of +30° and a reflectance B at a light receiving angle of −30° are measured by using a spectral varied angle color-difference meter GC5000L manufactured by Nippon Denshoku Industries Co., Ltd as a goniophotometer. Each of the reflectance A and the reflectance B is measured with light having a wavelength of 400 nm to 700 nm at intervals of 20 nm, and defined as an average of the reflectances at respective wavelengths. The ratio (A/B) is calculated from these measurement results.

Configuration of Brilliant Toner

It is preferable that the brilliant toner of this exemplary embodiment satisfies the following requirements of (1) and (2) from a viewpoint of satisfying the ratio (A/B) described above.

(1) The brilliant toner has an average equivalent circle diameter D longer than an average maximum thickness C with respect to the toner particles contained in the brilliant toner.

(2) When cross section of the brilliant toner particle in a thickness direction is observed, the number of pigment particles in which an angle between a long axis direction of the sectional surface of the brilliant toner particle and a long axis direction of the pigment particles is in a range of −30° to +30° is greater than or equal to 60% in the total observed pigment particles.

Here, FIG. 1 shows a cross-sectional view schematically illustrating a toner particle (the brilliant toner particle) satisfying the requirements of (1) and (2) described above is illustrated. Furthermore, a schematic diagram illustrated in FIG. 1 is a cross-sectional view of the brilliant toner particle in the thickness direction.

A brilliant toner particle 2 illustrated in FIG. 1 is a flake toner particle in which an equivalent circle diameter is greater than a thickness L, and contains flake-shape pigment particles 4 (corresponding to the brilliant pigment).

As illustrated in FIG. 1, it is considered that when the brilliant toner particle 2 is in the flake shape in which the equivalent circle diameter is greater than the thickness L, in fixing step of image formation, the flake brilliant toner is arranged such that a flake surface side thereof faces a surface of a recording medium due to a pressure at the time of fixing.

For this reason, it is considered that among the flake-shape pigment particles contained in the brilliant toner particle, the pigment particles that satisfy the requirement of "the angle between the long axis direction of the brilliant toner particle in the cross section and a long axis direction of the pigment particle is in the range of −30° to +30°" shown in (2) described above are arranged such that the surface side that provides the maximum area faces the surface of the recording medium. Thus, it is considered that when the formed image is irradiated with light, the ratio of the pigment particles which are diffusely reflected towards the incident light is prevented, and thus the range of the ratio (A/B) described above is attained. In addition, when the ratio of the pigment particles which are diffusely reflected towards the incident light is prevented, the intensity of the reflected light is considerably changed according to the observing angle, and thus more ideal brilliance is able to be obtained.

Hereinafter, a component configuring the brilliant toner of this exemplary embodiment will be described.

—Brilliant Pigment—

As the brilliant pigment used in this exemplary embodiment, for example, the following is used. Examples of the brilliant pigment include metal powders such as aluminum, brass, bronze, nickel, stainless steel, or zinc; mica on which titanium oxide or yellow iron oxide is coated; a coated laminar inorganic crystal substrate such as barium sulfate, layered silicate, or silicate of layered aluminum; single crystal plate-shaped titanium oxide; basic carbonate; acid bismuth oxychloride; natural guanine; laminar glass powder; and laminar glass powder which is subjected to metal vapor deposition, and there is no particular limitation as long it is a pigment having as the brilliant property.

With respect to the brilliant toner of this exemplary embodiment, it is preferable that the content of the brilliant pigment is from 4% by weight to 55% by weight with respect to the binder resin which will be described later. When the content of the brilliant pigment is greater than or equal to 4% by weight with respect to the binder resin, brilliance is easily improved. When the content of the brilliant pigment is less than or equal to 55% by weight with respect to the binder resin, flatness of the fixed image is improved, and as a result thereof, brilliance is easily improved.

—Binder Resin—

The brilliant toner of this exemplary embodiment may contain a binder resin.

Examples of the binder resins include a vinyl resin formed of homopolymer consisting of monomers such as styrenes (for example, styrene, p-chlorostyrene, α-methyl styrene, or the like), (meth)acrylic esters (for example, methyl acrylate, ethyl acrylate, n-propyl acrylate, n-butyl acrylate, lauryl acrylate, 2-ethylhexyl acrylate, methyl methacrylate, ethyl methacrylate, n-propyl methacrylate, lauryl methacrylate, 2-ethylhexyl methacrylate, or the like), ethylenic unsaturated nitriles (for example, acrylonitrile, methacrylonitrile, or the like), vinyl ethers (for example, vinyl methyl ether, vinyl isobutyl ether, or the like), vinyl ketones (for example, vinyl methyl ketone, vinyl ethyl ketone, vinyl isopropenyl ketone, or the like), olefins (for example, ethylene, propylene, butadiene, or the like), or a copolymer obtained by combining two or more kinds of these monomers.

Examples of the binder resin also include a non-vinyl resin such as an epoxy resin, a polyester resin, a polyurethane resin, a polyamide resin, a cellulose resin, a polyether resin, and a modified rosin, a mixture of these and the vinyl resin, or a graft polymer obtained by polymerizing a vinyl monomer in the presence of these.

These binder resins may be used alone or in combination with two or more kinds thereof.

As the binder resin, the polyester resin is preferable.

As the polyester resin, for example, a known amorphous polyester resin is included. As the polyester resin, a crystalline polyester resin may be used along with the amorphous polyester resin.

Furthermore, "crystallinity" of the resin indicates that the resin has an obvious endothermic peak in a differential scanning calorimetry (DSC) without having a step-like endothermic quantity change, and specifically, indicates that a half width of the endothermic peak at the time of being measured at a rate of a temperature increase of 10 (° C./min) is less than or equal to 10° C.

In contrast, "amorphousness" of the resin indicates that the half bandwidth is greater than 10° C., the resin shows the step-like endothermic quantity change, or the obvious endothermic peak is not confirmed.

Amorphous Polyester Resin

As the amorphous polyester resin, for example, a condensed polymer of a polycarboxylic acid and a polyol is included. Furthermore, as the amorphous polyester resin, a commercial product may be used, or a synthesized product may be used.

Examples of the polyvalent carboxylic acid include aliphatic dicarboxylic acids (e.g., oxalic acid, malonic acid, maleic acid, fumaric acid, citraconic acid, itaconic acid, glutaconic acid, succinic acid, alkenyl succinic acids, adipic acid, and sebacic acid), alicyclic dicarboxylic acids (e.g., cyclohexanedicarboxylic acid), aromatic dicarboxylic acids (e.g., terephthalic acid, isophthalic acid, phthalic acid, and naphthalenedicarboxylic acid), anhydrides thereof, or lower alkyl esters (having, for example, from 1 to 5 carbon atoms) thereof. Among these, for example, aromatic dicarboxylic acids are preferably used as the polyvalent carboxylic acid.

As the polyvalent carboxylic acid, a tri- or higher-valent carboxylic acid employing a crosslinked structure or a branched structure may be used in combination with a dicarboxylic acid. Examples of the tri- or higher-valent carboxylic acid include trimellitic acid, pyromellitic acid, anhydrides thereof, or lower alkyl esters (having, for example, from 1 to 5 carbon atoms) thereof.

The polyvalent carboxylic acids may be used alone or in combination of two or more kinds thereof.

Examples of the polyol include aliphatic diols (e.g., ethylene glycol, diethylene glycol, triethylene glycol, propylene glycol, butanediol, hexanediol, and neopentyl glycol), alicyclic diols (e.g., cyclohexanediol, cyclohexanedimethanol, and hydrogenated bisphenol A), and aromatic diols (e.g., ethylene oxide adducts of bisphenol A and propylene oxide adducts of bisphenol A). Among these, for example, aromatic dials and alicyclic dials are preferably used, and aromatic diols are more preferably used as the polyol.

As the polyol, a tri- or higher-valent polyol employing a crosslinked structure or a branched structure may be used in combination with a diol. Examples of the tri- or higher-valent polyol include glycerin, trimethylolpropane, and pentaerythritol.

The polyols may be used alone or in combination of two or more kinds thereof.

The glass transition temperature (Tg) of the amorphous polyester resin is preferably from 50° C. to 80° C., and is more preferably from 50° C. to 65° C.

Furthermore, the glass transition temperature is obtained by a DSC curve which is obtained by a differential scanning calorimetry (DSC), and more specifically, is obtained by "Extrapolating Glass Transition Starting Temperature" disclosed in a method for obtaining the glass transition temperature of "Testing Methods for Transition Temperatures of Plastics" in JIS K-7121-1987.

The weight average molecular weight (Mw) of the amorphous polyester resin is preferably from 5000 to 1000000, and is more preferably from 7000 to 500000.

The number average molecular weight (Mn) of the amorphous polyester resin is preferably from 2000 to 100000.

The molecular weight distribution Mw/Mn of the amorphous polyester resin is preferably from 1.5 to 100, and is more preferably from 2 to 60.

Furthermore, the weight average molecular weight and the number average molecular weight are measured by a gel permeation chromatography (GPC). The measurement of the molecular weight using the GPC is performed with a THF solvent by using, as a measurement device, HLC-8120GPC, a GPC manufactured by Tosoh Corporation and column•TSKgel SuperHM-M (15 cm), a column manufactured by Tosoh Corporation. The weight average molecular weight and the number average molecular weight are calculated by using a molecular weight calibration curve which is prepared by a monodisperse polystyrene standard sample from a measurement result thereof.

The amorphous polyester resin is able to be obtained by a known manufacturing method. Specifically, for example, the amorphous polyester resin is able to be obtained by a method in which a polymerization temperature is set to be from 180° C. to 230° C., as necessary, a reaction system is reduced, and the reaction is performed while removing water or alcohol which is generated at the time of condensation.

Furthermore, when a monomer of a raw material is not dissolved nor compatible at a reaction temperature, the monomer may be dissolved by adding a solvent having a high boiling point as a solubilizing agent. In this case, a polycondensation reaction is performed while distilling away the solubilizing agent. In the copolymerization reaction, when there is a monomer having low compatibility, the monomer having low compatibility and an acid or alcohol to be subjected to a polycondensation with the monomer may be condensed in advance, and then may be subjected to the polycondensation along with a main component.

Crystalline Polyester Resin

As the crystalline polyester resin, for example, a polycondensate of a polycarboxylic acid and a polyhydric alcohol is included. Furthermore, as the crystalline polyester resin, a commercial product may be used, or a synthesized product may be used.

Here, in order to easily form a crystal structure, it is preferable that the crystalline polyester resin is a polycondensate using a polymerizable monomer having a linear aliphatic series rather than a polymerizable monomer having an aromatic series.

As the polycarboxylic acid, for example, an aliphatic dicarboxylic acid (for example, an oxalic acid, a succinic acid, a glutaric acid, an adipic acid, a suberic acid, an azelaic acid, a sebacic acid, a 1,9-nonane dicarboxylic acid, a 1,10-decane dicarboxylic acid, a 1,12-dodecane dicarboxylic acid, a 1,14-tetradecane dicarboxylic acid, a 1,18-octadecane dicarboxylic acids), an aromatic dicarboxylic acid (for example, a dibasic acid such as a phthalic acid, an isophthalic acid, a terephthalic acid, and a naphthalene-2,6-dicarboxylic acid, and the like), and an anhydride thereof, or a lower alkyl ester (for example, having 1 to 5 carbon atoms) thereof are included.

As the polycarboxylic acid, a trivalent or higher valent carboxylic acid having a cross-linking structure or a branch structure may be used along with the dicarboxylic acid. As the trivalent carboxylic acid, for example, an aromatic carboxylic acid (for example, a 1,2,3-benzene tricarboxylic acid, a 1,2,4-benzene tricarboxylic acid, a 1,2,4-naphthalene tricarboxylic acid, and the like), and an anhydride thereof, or a lower alkyl ester (for example, having 1 to 5 carbon atoms) thereof are included.

As the polycarboxylic acid, a dicarboxylic acid having a sulphonic acid group and a dicarboxylic acid having an ethylenic double bond may be used along with the dicarboxylic acid.

As the polycarboxylic acid, one of the materials may be independently used, or a combination of two or more thereof may be used.

As the polyhydric alcohol, for example, aliphatic diol (for example, linear aliphatic diol having 7 to 20 carbon atoms in a main chain portion) is included. As the aliphatic diol, for example, ethylene glycol, 1,3-propane diol, 1,4-butane diol, 1,5-pentane diol, 1,6-hexane diol, 1,7-heptane diol, 1,8-octane diol, 1,9-nonane diol, 1,10-decane diol, 1,11-undecane diol, 1,12-dodecane diol, 1,13-tridecane diol, 1,14-tetradecane diol, 1,18-octadecane diol, 1,14-eicosane decane diol, and the like are included. Among them, as the aliphatic diol, the 1,8-octane diol, the 1,9-nonane diol, and the 1,10-decane diol are preferable.

As the polyhydric alcohol, trivalent or higher valent alcohol having a cross-linking structure or a branch structure may be used along with the diol. As the trivalent or higher valent alcohol, for example, glycerin, trimethylol ethane, trimethylol propane, pentaerythritol, and the like are included.

As the polyhydric alcohol, one of the materials may be independently used, or a combination of two or more thereof may be used.

Here, in the polyhydric alcohol, the content of the aliphatic diol may be greater than or equal to 80 mol %, and is preferably greater than or equal to 90 mol %.

The melting temperature of the crystalline polyester resin is preferably from 50° C. to 100° C., is more preferably from 55° C. to 90° C., and is even more preferably from 60° C. to 85° C.

Furthermore, the melting temperature is obtained by "Melting Peak Temperature" disclosed in a method for obtaining the melting temperature of "Testing Methods for Transition Temperatures of Plastics" in JIS K7121-1987 from a DSC curve obtained by a differential scanning calorimetry (DSC).

The weight average molecular weight (Mw) of the crystalline polyester resin is preferably from 6000 to 35000.

The crystalline polyester resin, for example, is able to be obtained by a known manufacturing method, as with the amorphous polyester resin.

The content of the binder resin, for example, is preferably from 40% by weight to 95% by weight, is more preferably from 50% by weight to 90% by weight, and is even more preferably from 60% by weight to 85% by weight, with respect to the total toner particles.

—Release Agent—

The brilliant toner of this exemplary embodiment may contain a release agent.

As the release agent used in this exemplary embodiment, for example, paraffin wax such as low molecular weight polypropylene, low molecular weight polyethylene or the like; a silicone resin; rosins; rice wax; carnauba wax; and the like are included. The melting temperature of the release agent is preferably from 50° C. to 100° C., and is more preferably from 60° C. to 95° C.

—Other Additive Agent—

In this exemplary embodiment, as necessary, various components such as an internal additive agent, a charge-controlling agent, an inorganic power (inorganic particles), and organic particles may be used in addition to the components described above.

As the charge-controlling agent, for example, a dye including a complex such as a quaternary ammonium salt compound, a nigrosine compound, aluminum, iron, and chromium, and a triphenyl methane pigment, and the like are included.

As the inorganic particles, for example, known inorganic particles such as silica particles, titanium oxide particles, alumina particles, cerium oxide particles, or those obtained by treating the surfaces of these particles with a hydrophobizing agent may be independently used, or a combination of two or more thereof may be used. Among them, the silica particles of which the refractive index is less than that of the binder resin are preferably used. In addition, the silica particles may be subjected to various surface treatments, and for example, silica particles which are subjected to a surface treatment by using a silane coupling agent, a titanium coupling agent, silicone oil, and the like are preferably used.

—Properties of Brilliant Toner—

Average Maximum Thickness C and Average Equivalent Circle Diameter D

As shown in (1) described above, it is preferable that the brilliant toner of this exemplary embodiment has the average equivalent circle diameter D which is greater than the average maximum thickness C. Furthermore, a ratio (C/D) of the average maximum thickness C to the average equivalent circle diameter D is preferably in a range of 0.001 to 0.500, is more preferably in a range of 0.001 to 0.200, is even more preferably in a range of 0.010 to 0.200, and is particularly preferably in a range of 0.050 to 0.100.

By setting the ratio (C/D) to be greater than or equal to 0.001, the intensity of the brilliant toner is ensured, a fracture due to stress at the time of forming an image is prevented, and a decrease in charging due to the exposure of the pigment and fogging generated therefrom are prevented. On the other hand, by setting the ratio (C/D) to be less than or equal to 0.500, excellent brilliance is able to be obtained.

The average maximum thickness C and the average equivalent circle diameter D described above are measured by the following method.

The brilliant toner is applied to a smooth surface and is dispersed with vibration so as not to have unevenness. 1000 brilliant toner particles are observed with a color laser microscope "VK-9700" (manufactured by Keyence Corporation) with a magnification power of 1000, the maximum thickness C and the equivalent circle diameter D of a top view are measured, and arithmetic average values thereof are calculated to obtain the average maximum thickness C and the average equivalent circle diameter D.

Angle Between Major Axis Direction of Sectional Surface of Brilliant Toner and Major Axis Direction of Pigment Particles As shown in (2) described above, when the sectional surface of the brilliant toner particle in the thickness direction is observed, it is preferable that the number of pigment particles in which the angle between the long axis direction of the sectional surface of the brilliant toner particle and the long axis direction of the pigment particles is in the range of −30° to +30° is greater than or equal to 60% of the total observed pigment particles. Further, the number of pigment particles is more preferably from 70% to 95%, and is particularly preferably from 80% to 90%.

By setting the number of pigment particles to be greater than or equal to 60%, excellent brilliance is able to be obtained.

Here, an observation method of the sectional surface of the brilliant toner (particles) will be described.

The brilliant toner is embedded by using a bisphenol A type liquid epoxy resin and a curing agent, and then a sample for cutting is prepared. Next, the cutting sample is cut at −100° C. by using a cutting machine with a diamond knife (in this exemplary embodiment, by using a LEICA Ultramicrotome (manufactured by Hitachi High-Technologies Corporation)), and a sample for observation is prepared. In the sample for observation, the sectional surface of the brilliant toner particles is observed around a magnification of 5000 times by using a transmission electron microscope (TEM). The number of pigment particles in which the angle between the long axis direction of the sectional surface of the brilliant toner particle and the long axis direction of the pigment particles is in the range of −30° to +30° is calculated with respect to the observed 1000 brilliant toner particles by using image analysis software, and the ratio is calculated.

Furthermore, "the long axis direction of the sectional surface of the brilliant toner particle" indicates a direction orthogonal to the thickness direction of the brilliant toner in which the average equivalent circle diameter D is greater than the average maximum thickness C, and "the long axis direction of the pigment particles" indicates a length direction of the pigment particles.

In addition, the volume average particle diameter of the brilliant toner of this exemplary embodiment is preferably from 1 μm to 30 μm, is more preferably from 3 μm to 20 μm, and is even more preferably from 5 μm to 10 μm.

Furthermore, the volume average particle diameter $D_{50v}$ described above is defined as follows. A cumulative distribution of each of the volume and the number from a small diameter side with respect to a particle diameter range (a channel) divided on the basis of a particle diameter distribution which is measured by a measurement device such as MULTISIZER II (manufactured by Beckman Coulter Inc.). The particle diameter when the cumulative percentage becomes 16% is defined as that corresponding to a volume $D_{16v}$ and a number $D_{16p}$, while the particle diameter when the cumulative percentage becomes 50% is defined as that corresponding to a volume $D_{50v}$ and a number $D_{50p}$. Furthermore, the particle diameter when the cumulative percentage becomes 84% is defined as that corresponding to a volume $D_{84v}$ and a number $D_{84p}$. Using these, a volume average particle size distribution index (GSDv) is calculated as $(D_{84v}/D_{16v})^{1/2}$.

In this exemplary embodiment, the endothermic quantity of the toner is a value measured by a differential scanning calorimetry (DSC). Specifically, as to the endothermic quantity of the toner, a differential scanning calorimeter is used, the melting temperature of a mixture of indium and zinc is used in a temperature correction of a detecting unit of a device, and melting heat of indium is used in a correction of a heat quantity. A sample (the toner) is put into an aluminum pan, the aluminum pan into which the sample is put and an empty aluminum pan for comparison are set, and are measured at a rate of a temperature increase 10° C./min. The endothermic quantity is calculated from an endothermic portion of a DSC curve obtained by the measurement.

In this exemplary embodiment, the endothermic quantity of the brilliant toner is from 1.2 times to 5 times the endothermic quantity of the chromatic toner, is preferably from 1.5 times to 4.0 times the endothermic quantity of the chromatic toner, and is more preferably from 2.0 times to 3.5 times the endothermic quantity of the chromatic toner.

In this exemplary embodiment, the endothermic quantity of the brilliant toner is preferably from 150 mJ/g to 300 mJ/g, is more preferably from 170 mJ/g to 260 mJ/g, and is even more preferably from 190 mJ/g to 250 mJ/g. In addition, in this exemplary embodiment, the endothermic quantity of the chromatic toner is preferably from 60 mJ/g to 125 mJ/g, is more preferably from 65 mJ/g to 110 mJ/g, and is even more preferably from 72 mJ/g to 95 mJ/g.

Next, a component configuring the chromatic toner of this exemplary embodiment will be described.

The chromatic toner of this exemplary embodiment may be a known toner of the related art which contains a coloring agent, and the configuration thereof is not particularly limited. For example, the chromatic toner may have the same configuration as that of the brilliant toner except that the following coloring agent is contained instead of the brilliant pigment used in the brilliant toner of this exemplary embodiment.

—Coloring Agent—

The coloring agent used in this exemplary embodiment may be a dye or a pigment, but it is preferable that the coloring agent is a pigment from a viewpoint of light resistance or water resistance. As the coloring agent, one may be independently used, or a combination of two or more thereof may be used.

As the coloring agent which may be used in this exemplary embodiment, for example, the following are included.

As a yellow coloring agent, chrome yellow, zinc yellow, yellow iron oxide, cadmium yellow, chromium yellow, hansa yellow, hansa yellow 10G, benzidine yellow G, benzidine yellow GR, threne yellow, quinoline yellow, permanent yellow NCG, and the like are included.

As a blue coloring agent, iron blue, cobalt blue, alkali blue lake, victoria blue lake, fast sky blue, indanthrene blue BC, aniline blue, ultramarine blue, calco oil blue, methylene blue chloride, phthalocyanine blue, phthalocyanine green, malachite green oxalate, and the like are included.

As a red coloring agent, bengala, cadmium red, red lead, mercury sulfide, watch young red, permanent red 4R, lithol red, brilliant carmine 3B, brilliant carmine 6B, du pont oil red, pyrazolone red, rhodamine B lake, lake red C, rose bengal, eoxine red, alizarin lake, and the like are included.

As a green coloring agent, chromium oxide, chromium green, pigment green, malachite green lake, final yellow green G, and the like are included.

As an orange coloring agent, red chromium yellow, molybdenum orange, permanent orange GTR, pyrazolone orange, vulcan orange, benzidine orange G, indanthrene brilliant orange RK, indanthrene brilliant orange GK, and the like are included.

As a purple coloring agent, manganese violet, fast violet B, methyl violet lake, and the like are included.

As a black coloring agent, carbon black, copper oxide, manganese dioxide, aniline black, activated carbon, nonmagnetic ferrite, magnetite, and the like are included.

In the chromatic toner of this exemplary embodiment, the content of the coloring agent is preferably from 0.05% by weight to 12% by weight, and is more preferably from 0.5% by weight to 8% by weight, with respect to the binder resin.

In addition, the volume average particle diameter of the chromatic toner of this exemplary embodiment is preferably from 1 μm to 10 μm, is more preferably from 2 μm to 8 μm, and is even more preferably from 3 μm to 6 μm.

Preparing Method of Toner

The brilliant toner and the chromatic toner of this exemplary embodiment (hereinafter, simply and collectively referred to as the "toner" in some cases) may be prepared by manufacturing the brilliant toner particles or the chromatic toner particles (hereinafter, collectively referred to as the "toner particles" in some cases), and then by adding an external additive agent to the toner particles.

A manufacturing method of the toner particles is not particularly limited, and the toner particles are prepared by a dry method such as a kneading and pulverizing manufacturing method which has been known, a wet method such as an emulsion aggregating method, a suspension polymerization method, and the like.

The kneading and pulverizing manufacturing method is a method in which the respective materials including the coloring agent are mixed, and then the materials described above are melted and kneaded by using a kneader, an extruder, and the like, the obtained melted and kneaded substance is subjected to coarse grinding, and then is subjected to pulverizing by using a jet mill or the like, and the toner particles having a desired particle diameter are obtained by using a wind classifier.

Among the methods, an emulsion aggregating method is preferable in which the shape of the toner particles or the particle diameter of the toner particles is easily controlled, and a control range of a toner particle structure such as a core shell structure is wide. Hereinafter, the manufacturing method of the toner particles by using the emulsion aggregating method will be described in detail.

The emulsion aggregating method of this exemplary embodiment includes an emulsification step of forming resin particles (emulsification particles) or the like by emulsifying a raw material configuring the toner particles, an aggregating step of forming an aggregate of the resin particles, and a coalescing step of making the aggregate coalesce.

Emulsification Step

A resin particle dispersion may be prepared by applying, by a disperser, a shear force to a solution in which an aqueous medium and a binder resin are mixed to emulsify the solution, in addition to a case where a resin particle dispersion is prepared by using a general polymerization method, for example, an emulsification polymerization method or a suspension polymerization method, a dispersion polymerization method and the like. At this time, the particles may be formed by decreasing the viscosity of the resin component due to heating. In addition, in order to stabilize the dispersed resin particles, a dispersing agent may be used. Further, when the resin is oil-based and thus is dissolved in a solvent which has comparatively low solubility with respect to water, the resin is dissolved in the solvent, and the particles are dispersed in water along with the dispersing agent or a polymeric electrolyte, and then are heated or reduced in order to evaporate the solvent, and thus the resin particle dispersion is prepared.

As the aqueous medium, for example, water such as distilled water, and ion exchange water; alcohols, and the like are included, and the water is preferable.

In addition, as the dispersing agent used in the emulsification step, for example, a water-soluble polymer such as polyvinyl alcohol, methyl cellulose, ethyl cellulose, hydroxy ethyl cellulose, carboxy methyl cellulose, sodium polyacrylate, and sodium polymethacrylate; a surfactant such as an anionic surfactant such as sodium dodecyl benzene sulphonate, sodium octadecyl sulfate, sodium oleate, sodium laurate, and potassium stearate, a cationic surfactant such as lauryl amine acetate, stearyl amine acetate, and lauryl trimethyl ammonium chloride, an amphoteric surfactant such as lauryl dimethyl amine oxide, and a nonionic surfactant such as polyoxy ethylene alkyl ether, polyoxy ethylene alkyl phenyl ether, and polyoxy ethylene alkyl amine; an inorganic salt such as tricalcium phosphate, aluminum hydroxide, calcium sulfate, calcium carbonate, and barium carbonate; and the like are included.

As the disperser used for preparing the emulsified liquid, for example, a homogenizer, a homomixer, a pressurizing kneader, an extruder, a media disperser, and the like are included. As the size of the resin particles, the average particle diameter (the volume average particle diameter) is preferably less than or equal to 1.0 μm, is more preferably in a range of 60 nm to 300 nm, and is even more preferably in a range of 150 nm to 250 nm. When the average particle diameter is greater than or equal to 60 nm, the resin particles easily become unstable particles in the dispersion, and thus the resin particles may be easily aggregated. In addition, when the average particle diameter is less than or equal to 1.0 μm, a particle diameter distribution of the toner may be narrowed.

In the preparation of a release agent dispersion, a release agent is dispersed in water, together with an ionic surfactant or a polymer electrolyte such as a polymer acid or a polymer base, and then a dispersion treatment is performed using a homogenizer or a pressure discharge-type dispersing machine with which a strong shear force is applied thereto, simultaneously with heating at a temperature that is not lower than the melting temperature of the release agent. The release agent dispersion is obtained through such a treatment. In the dispersion treatment, an inorganic compound such as polyaluminum chloride may be added to the dispersion. Examples of the preferable inorganic compound include polyaluminum chloride, aluminum sulfate, highly basic polyaluminum chloride (BAC), polyaluminum hydroxide, and aluminum chloride. The release agent dispersion described above is used in the emulsion aggregating method, and the release agent dispersion described above may also be used at the time of manufacturing the toner by the suspension polymerization method.

Through the dispersion treatment, a release agent dispersion containing release agent particles having a volume average particle diameter of 1 μm or less is obtained. More preferably, the volume average particle diameter of the release agent particles is from 100 nm to 500 nm.

When the volume average particle diameter is 100 nm or greater, the characteristics of the binder resin to be used are also affected, but generally, the release agent component is easily incorporated in the toner. When the volume average particle diameter is 500 nm or less, the release agent in the toner has a superior dispersion state.

In the preparation of the coloring agent dispersion and the brilliant pigment dispersion, a known dispersion method is able to be used, and for example, a general dispersion unit such as a rotating shear type homogenizer, or those having media such as a ball mill, a sand mill, a DYNO mill, and an ultimizer is able to be adopted, but the unit is not limited thereto. The coloring agent is dispersed in water along with an ionic surfactant or a polymer electrolyte such as a polymer acid or a polymer base.

In addition, the brilliant pigment and the binder resin may be dispersed and dissolved in the solvent to be mixed, and may be dispersed in water by phase inversion emulsification or shear emulsification, and thus a dispersion of the brilliant pigment coated with the binder resin may be prepared.

Aggregating Step

In the aggregating step, the resin particle dispersion, the coloring agent dispersion, the brilliant pigment dispersion, the release agent dispersion, and the like are mixed to be a mixed solution, and are aggregated by being heated at a temperature of lower than or equal to the glass transition temperature of the resin particles, and thus aggregated particles are formed. The aggregated particles are usually formed by setting the pH of the mixed solution to acidity while being stirred. The pH is preferably in a range of 2 to 7, and at this time, it is effective to use an aggregating agent.

Furthermore, in the aggregating step, the release agent dispersion may be added and mixed along with various dispersions such as the resin particle dispersion one time, or may be added in a plurality of times.

As the aggregating agent, a bivalent or higher valent metal complex is preferably used in addition to a surfactant having a polarity which is reverse to that of the surfactant used in the dispersing agent, and an inorganic metal salt. In particular, when a metal complex is used, it is possible to decrease the amount of the surfactant used, and charging properties are improved, and thus the metal complex is particularly preferable.

As the inorganic metal salt, aluminum salts and polymers thereof are particularly preferable. In order to obtain a narrower particle size distribution, the valence of the inorganic metal salt is more preferably divalent than monovalent, trivalent than divalent, or tetravalent than trivalent, and further, in the case of the same valences as each other, a polymer-type inorganic metal salt polymer is more suitable.

In this exemplary embodiment, a polymer of tetravalent inorganic metal salt including aluminum is preferably used to obtain a narrow particle size distribution.

In addition, when the aggregated particles have a desired particle diameter, the resin particle dispersion may be further added (a covering step), and thus the toner having a configuration in which the surface of core aggregated particles is coated with a resin may be prepared. In this case, the release agent, the coloring agent, or the brilliant pigment is rarely exposed to a toner surface, and thus this configuration is preferable from a viewpoint of charging properties or developing properties. When the resin particle dispersion is further added, the aggregating agent may be added or the pH may be adjusted before further adding the resin particle dispersion.

Coalescing Step

In the coalescing step, the progress of the aggregation is stopped by increasing the pH of a suspension of the aggregated particles to a range of 3 to 9 in stirring conditions based on the aggregating step, and the aggregated particles coalesce by heating the aggregated particles at a temperature of higher than or equal to the glass transition temperature of the resin. In addition, when the aggregated particles are coated with the resin, the resin also coalesces, and the core aggregated particles are coated. The heating may be performed to the extent that coalescence occurs, and may be performed for approximately 0.5 hours to 10 hours.

The aggregated particles are cooled after coalescence, and the coalesced particles are able to be obtained. In addition, in a cooling step, crystallization may be promoted by decreasing a cooling rate in the vicinity of the glass transition temperature of the resin (a range of the glass transition temperature±10° C.), that is, by performing gradual cooling.

The coalesced particles which are obtained through coalescence become the toner particles through a solid-liquid separation step such as filtration, or as necessary, a cleaning step, and a drying step.

To the obtained toner particles, an inorganic oxide represented by silica, titania, and aluminum oxide, and the like are added and attached as the external additive agent in order to adjust the charging, to impart fluidity, and to impart charge exchanging properties. This, for example, is able to be performed by a V-type blender, a HENSCHEL mixer, a LöDIGE mixer, and the like, and the attachment may be performed in steps. The added amount of the external additive agent is preferably in a range of 0.1 parts by weight to 5 parts by weight, and is more preferably in a range of 0.3 parts by weight to 2 parts by weight, with respect to 100 parts by weight of the toner particles.

Further, as necessary, coarse particles of the toner may be eliminated by using an ultrasonic sieving machine, a vibration sieving machine, a wind classifier, and the like after the external addition.

In addition to the inorganic oxide or the like described above, other components (particles) such as a charge-controlling agent, organic particles, a lubricant, and an abrasive may be added as the external additive agent.

The charge-controlling agent is not particularly limited, and as the charge-controlling agent, a colorless or a hypochromic charge-controlling agent is preferably used. For example, a complex of a quaternary ammonium salt compound, a nigrosine compound, aluminum, iron, chromium, and the like, a triphenyl methane pigment, and the like are included.

As the organic particles, for example, particles which are generally used as an external additive agent of the toner surface such as a vinyl resin, a polyester resin, and a silicone resin are included. Furthermore, these inorganic particles or organic particles are used as a fluidity auxiliary agent, a cleaning auxiliary agent, and the like.

As the lubricant, for example, fatty acid amide such as ethylene bis-stearic acid amide, and oleic amide, a fatty acid metal salt such as zinc stearate, and calcium stearate, and the like are included.

As the abrasive agent, for example, the silica described above, alumina, cerium oxide, and the like are included.

In this exemplary embodiment, as a method of setting the ratio of the endothermic quantity of the brilliant toner and the endothermic quantity of the chromatic toner to be in the above-described range which is determined in advance, for example, a method is included in which a crystalline resin is contained in the brilliant toner. In this case, the content ratio of the crystalline resin in the brilliant toner is preferably in a range of 3% by weight to 20% by weight, is more preferably in a range of 5.5% by weight to 17% by weight, and is even more preferably in a range of 8% by weight to 15% by weight. In this case, the content ratio of the crystalline resin in the chromatic toner is preferably in a range of 0% by weight to 4% by weight, is more preferably in a range of 1% by weight to 3.5% by weight, and is even more preferably in a range of 2% by weight to 3% by weight. The endothermic quantity of the toner easily increases according to an increase in the content of the crystalline resin in the toner.

As the crystalline resin, for example, a crystalline vinyl resin and the like may be used in addition to the crystalline polyester resin described above. Among them, as the crystalline resin, the crystalline polyester resin is preferable.

In addition, the amount of the release agent is adjusted in addition to the amount of the crystalline resin, and thus the ratio of the endothermic quantity of the brilliant toner and the endothermic quantity of the chromatic toner is able to be adjusted. As the amount of the release agent, the content ratio of the release agent in the brilliant toner is preferably in a range of 5% by weight to 15% by weight, is more preferably in a range of 5.5% by weight to 13% by weight, and is even more preferably in a range of 6.5% by weight to 10% by weight. In this case, the content ratio of the release agent in the chromatic toner is preferably in a range of 0.5% by weight to 9% by weight, is more preferably in a range of 3% by weight to 8% by weight, and is even more preferably in a range of 4% by weight to 7.5% by weight.

In addition, adjusting the aspect ratio or the volume average particle diameter of the brilliant pigment is also effective for adjusting the endothermic quantity of the toner.

Developer

The toner of this exemplary embodiment, may be used as a one-component developer, or may be used as a two-component developer by being mixed with a carrier.

The carrier which is able to be used in the two-component developer is not particularly limited, and as the carrier, a known carrier is used. For example, magnetic metal such as iron oxide, nickel, and cobalt, magnetic oxide such as ferrite, and magnetite, a resin coated carrier having a resin coating layer on a core surface of these materials, a magnetic dispersion-type carrier, and the like are included. In addition, a resin dispersion-type carrier may be used in which a conductive material or the like is dispersed in a matrix resin.

As the covering resin and the matrix resin used in the carrier, polyethylene, polypropylene, polystyrene, polyvinyl acetate, polyvinyl alcohol, polyvinyl butyral, polyvinyl chloride, polyvinyl ether, polyvinyl ketone, a vinyl chloride-vinyl acetate copolymer, a styrene-acrylic acid copolymer, a straight silicone resin formed of an organosiloxane bond or a modified article thereof, a fluorine resin, a polyester, a polycarbonate, a phenol resin, an epoxy resin, and the like are exemplified, but the resin is not limited thereto.

As the conductive material, metal such as gold, silver, and copper, carbon black, titanium oxide, zinc oxide, barium sulphate, aluminum borate, potassium titanate, tin oxide, and the like are exemplified, but the material is not limited thereto.

In addition, as a core of the carrier, magnetic metal such as iron, nickel, and cobalt, magnetic oxide such as ferrite, and magnetite, a glass bead, and the like are included, and a magnetic material is preferable in order to use the carrier in a magnetic brush method. The volume average particle diameter of the core of the carrier is generally in a range of 10 μm to 500 μm, and is preferably in a range of 30 μm to 100 μm.

In addition, in order to coat the surface of the core of the carrier with a resin, a method of coating the surface with a solution for forming a coating layer, in which the coating resin, and as necessary, various additive agents are dissolved in a suitable solvent is included. The solvent is not particularly limited, and may be selected according to the coating resin to be used, coating suitability, and the like.

Specific examples of the resin coating method include a dipping method of dipping the cores of the carrier in a coating layer forming solution; a spraying method of spraying a coating layer forming solution onto surfaces of cores of the carrier; a fluidized bed method of spraying a coating layer forming solution in a state in which cores of the carrier are allowed to float by flowing air; and a kneader-coater method in which cores of a carrier and a coating layer forming solution are mixed with each other in a kneader-coater and the solvent is removed.

As a mixed ratio (a weight ratio) of the toner of this exemplary embodiment and the carrier described above in the two-component developer, a brilliant toner:carrier ratio is preferably in a range of 1:100 to 30:100, and is more preferably in a range of 3:100 to 20:100.

Image Forming Apparatus and Image Forming Method

The image forming apparatus of this exemplary embodiment includes a plurality of toner image forming units including at least a first toner image forming unit which forms a brilliant toner image by using the brilliant toner including the brilliant pigment and a second toner image forming unit which forms a chromatic toner image by using the chromatic toner including the coloring agent, a transferring unit transferring the brilliant toner image and the chromatic toner image onto a recording medium, and a fixing unit fixing the brilliant toner image and the chromatic toner image onto the recording medium. Here, the endothermic quantity of the brilliant toner is from 1.2 times to 5 times the endothermic quantity of the chromatic toner.

As the toner image forming unit of this exemplary embodiment, a latent image holding member, a charging unit charging the surface of the latent image holding member, an electrostatic charge image forming unit forming an electrostatic charge image on the surface of the latent image holding member, and a developing unit developing the electrostatic charge image by a developer including the brilliant toner or the chromatic toner to form a toner image may be included.

By using the image forming apparatus of this exemplary embodiment, the image forming method of this exemplary embodiment including a plurality of toner image forming steps which includes at least a first toner image forming step of forming a brilliant toner image by using the brilliant toner including the brilliant pigment, a second toner image forming step of forming a chromatic toner image by using the chromatic toner including the coloring agent, a transferring step of transferring the brilliant toner image and the chromatic toner image onto the recording medium, and a fixing step of fixing the brilliant toner image and the chromatic toner image onto a recording medium, in which the endothermic quantity of the brilliant toner is from 1.2 times to 5 times the endothermic quantity of the chromatic toner is performed.

The image forming apparatus of this exemplary embodiment, for example, may be an image forming apparatus which sequentially and repeatedly performs primary transfer of each toner image held on the latent image holding member with respect to an intermediate transfer medium, a tandem-type image forming apparatus in which a plurality of latent image holding bodies including a developing unit for each color is arranged on the intermediate transfer medium in series, and the like.

Furthermore, in the image forming apparatus of this exemplary embodiment, for example, a portion including the developing unit in which the developer is contained may have a cartridge structure (a process cartridge) attachable to and detachable from the image forming apparatus, and a portion containing a toner for replenishment to be supplied to the developing unit may have a cartridge structure (a toner cartridge) attachable to and detachable from the image forming apparatus.

Hereinafter, the image forming apparatus of this exemplary embodiment will be described with reference to the drawings.

Figure 2:
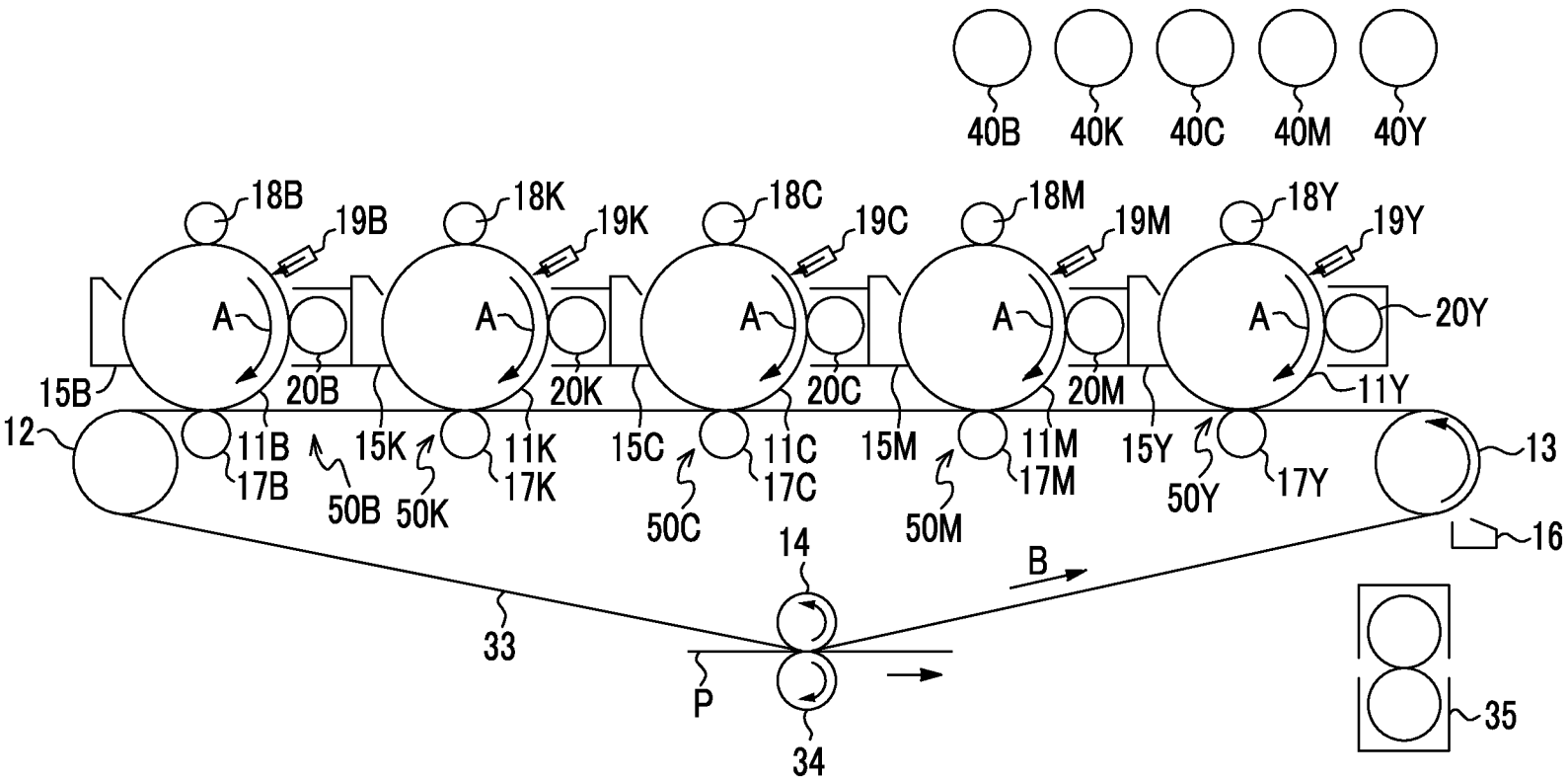
FIG. 2 is a schematic configuration diagram illustrating an example of an image forming apparatus of this exemplary embodiment.

FIG. 2 is a schematic configuration diagram illustrating an example of the image forming apparatus of this exemplary embodiment. The image forming apparatus of this exemplary embodiment has a tandem-type configuration in which a plurality of photoreceptors as the latent image holding member, that is, a plurality of image forming units (image forming units) is disposed.

In the image forming apparatus of this exemplary embodiment, as illustrated in FIG. 2, five image forming units 50Y, 50M, 50C, 50K, and 50B which form a toner image of each color of yellow, magenta, cyan, black, and brilliant silver are arranged in parallel (in the shape of a tandem) at intervals. Furthermore, each of the image forming units is arranged from the upstream side in a rotation direction of an intermediate transfer belt 33 in the order of the image forming units 50Y, 50M, 50C, 50K, and 50B.

Here, each of the image forming units 50Y, 50M, 50C, 50K, and 50B has the same configuration except for the color of the toner of the developer contained in each of the image forming units, and thus the image forming unit 50Y forming a yellow image will be described as a representative. Furthermore, reference numerals such as magenta (M), cyan (C), black (K), and brilliant silver (B) are applied to the same portions as that of the image forming unit 50Y instead of yellow (Y), and thus the description of each of the image forming units 50M, 50C, 50K, and 50B will be omitted.

The yellow image forming unit 50Y includes a photoreceptor 11Y as the latent image holding member, and the photoreceptor 11Y is rotary driven by a driving unit (not illustrated) in an illustrated arrow A direction at a process speed which is determined in advance. As the photoreceptor 11Y, for example, an organic photoreceptor having sensitivity in an infrared region is used.

A charging roll (the charging unit) 18Y is disposed on an upper portion of the photoreceptor 11Y, an electric voltage which is determined in advance is applied to the charging roll 18Y by an electric power source (not illustrated), and thus the surface of the photoreceptor 11Y is charged to an electric potential which is determined in advance.

An exposure device (the electrostatic charge image forming unit) 19Y which exposes the surface of the photoreceptor 11Y and forms the electrostatic charge image is arranged around the photoreceptor 11Y, on the downstream side of the charging roll 18Y in a rotation direction of the photoreceptor 11Y. Furthermore, here, as the exposure device 19Y, an LED array is used in which downsizing is realized because of space limitations, but the exposure device is not limited thereto, and the other electrostatic charge image forming unit using a laser beam or the like may also be used.

In addition, a developing device (developing unit) 20Y which includes a developer holding member holding a yellow developer is arranged around the photoreceptor 11Y on the downstream side of the exposure device 19Y in the rotation direction of the photoreceptor 11Y, and has a configuration in which the electrostatic charge image formed on the surface of the photoreceptor 11Y is developed by a yellow toner, and thus the toner image is formed on the surface of the photoreceptor 11Y.

The intermediate transfer belt (a primary transferring unit) 33 performing primary transfer with respect to the toner image formed on the surface of the photoreceptor 11Y is arranged in a lower portion of the photoreceptor 11Y to extend over a lower portion of the five photoreceptors 11Y, 11M, 11C, 11K, and 11B. The intermediate transfer belt 33 is pressed to the surface of the photoreceptor 11Y by a primary transfer roll 17Y. In addition, the intermediate transfer belt 33 is stretched by three rolls of a driving roll 12, a supporting roll 13, and a bias roll 14, and is circumferentially moved in an arrow B direction at a movement speed identical to the process speed of the photoreceptor 11Y. The yellow toner image is primarily transferred onto the surface of the intermediate transfer belt 33, and the toner image of each color of magenta, cyan, black, and brilliant silver is primarily transferred in sequence.

A cleaning device 15Y for cleaning the remaining toner or the retransferred toner on the surface of the photoreceptor 11Y is arranged around the photoreceptor 11Y on the downstream side of the primary transfer roll 17Y in the rotation direction (the arrow A direction) of the photoreceptor 11Y. A cleaning blade of the cleaning device 15Y is attached to be in pressure contact with surface of the photoreceptor 11Y in a counter direction.

A secondary transfer roll (a secondary transferring unit) 34 is in pressure contact with the bias roll 14 by which the intermediate transfer belt 33 is stretched through the intermediate transfer belt 33. The toner image which is primarily transferred and laminated on the surface of the intermediate transfer belt 33 is electrostatically transferred onto the surface of recording paper (the recording medium) P fed from a paper cassette (not illustrated) in a pressure contacting portion between the bias roll 14 and the secondary transfer roll 34.

In addition, a fixing device (the fixing unit) 35 for fixing the toner image which is multiply transferred onto the recording paper P to the surface of the recording paper P using heat and pressure to forming a permanent image is arranged on the downstream side of the secondary transfer roll 34.

Furthermore, as the fixing device 35, for example, a fixing belt which is formed in the shape of a belt by using a low surface energy material represented by a fluorine resin component or a silicone resin on the surface, and a fixing roll which is formed in the shape of a cylinder by using a low surface energy material represented by a fluorine resin component or a silicone resin on the surface are included.

Next, the operation of each of the image forming units 50Y, 50M, 50C, 50K, and 50B which forms an image of each color of yellow, magenta, cyan, black, and brilliant silver will be described. The operations of the respective image forming units 50Y, 50M, 50C, 50K, and 50B are identical to each other, and thus the operation of the yellow image forming unit 50Y will be described as a representative.

In the yellow developing unit 50Y, the photoreceptor 11Y is rotated in the arrow A direction at a process speed which is determined in advance. The surface of the photoreceptor 11Y is subjected to negative charging to an electric potential which is determined in advance by the charging roll 18Y. After that, the surface of the photoreceptor 11Y is exposed by the exposure device 19Y, and the electrostatic charge image according to image information is formed. Subsequently, the toner which has been subjected to the negative charging by the developing device 20Y is reversely developed, and the electrostatic charge image formed on the surface of the photoreceptor 11Y is visualized on the surface of the photoreceptor 11Y, and thus the toner image is formed. After that, the toner image on the surface of the photoreceptor 11Y is primarily transferred onto the surface of the intermediate transfer belt 33 by the primary transfer roll 17Y. After the primary transfer, a transfer residual component such as the toner or the like remaining on the surface of the photoreceptor 11Y is scraped out by the cleaning blade of the cleaning device 15Y and is cleaned, and the photoreceptor 11Y is prepared for the next image forming step.

The operations described above are performed by each of the image forming units 50Y, 50M, 50C, 50K, and 50B, the toner image which is visualized on the surface of each of the photoreceptors 11Y, 11M, 11C, 11K, and 11B is multiply transferred onto the surface of the intermediate transfer belt 33 in sequence. The toner image of each color is multiply transferred in the order of yellow, magenta, cyan, black, and brilliant silver, and even in a case of a two-color mode, and a three-color mode, only the toner image of a necessary color is independently or multiply transferred in this sequence.

Furthermore, in the image forming apparatus according to FIG. 2, the toner image is multiply transferred in the order of yellow, magenta, cyan, black, and brilliant silver, and in this exemplary embodiment, the sequence of the multiple transfer of the toner image may be changed by altering a positional relationship of each of the image forming units 50Y, 50M, 50C, 50K, and 50B.

After that, the toner image which is independently or multiply transferred onto the surface of the intermediate transfer belt 33 is secondarily transferred onto the surface of the recording paper P which has been fed from the paper cassette (not illustrated) by the secondary transfer roll 34, and then is fixed by being heated and pressed by the fixing device 35. After the secondary transfer, the toner remaining on the surface of the intermediate transfer belt 33 is cleaned by a belt cleaner 16 configured of a cleaning blade for the intermediate transfer belt 33.

Furthermore, the yellow image forming unit 50Y is configured as the process cartridge which is formed by integrating the developing device 20Y which includes the developer holding member holding the yellow developer, the photoreceptor 11Y, the charging roll 18Y, and the cleaning device 15Y, and is attachable to and detachable from the image forming apparatus. In addition, the image forming units 50M, 50C, 50K, and 50B are also configured as the process cartridge, as with the image forming unit 50Y.

In addition, each of the toner cartridges 40Y, 40M, 40C, 40K, and 40B is a cartridge which contains the toner of each color and is attachable to and detachable from the image forming apparatus, and is connected to the developing device corresponding to each color through a toner supply tube (not illustrated). Then, when the toner contained in each of the toner cartridges decreases, the toner cartridge is replaced.

In this exemplary embodiment, a ratio of the amount of brilliant toner applied and the amount of brilliant toner applied (in a case of using two or more types of chromatic toners, the total amount of the chromatic toners) is preferably 1:0.5 to 1:4, and is more preferably 1:1 to 1:3.

EXAMPLES

Hereinafter, this exemplary embodiment will be described in detail on the basis of examples, but this exemplary embodiment is not limited to the following examples. Furthermore, "parts" and "%" indicate "parts by weight" and "% by weight" unless particularly stated otherwise.

(Synthesis of Amorphous Polyester Resin)

Dimethyl adipate: 74 parts

Dimethyl terephthalate: 192 parts

Bisphenol A ethylene oxide adduct: 216 parts

Ethylene glycol: 38 parts

Tetrabutoxy titanate (Catalyst): 0.037 parts

The components described above are put into a two-necked flask which has been heated and dried, nitrogen gas is put into the container to maintain the inside thereof in an inert atmosphere, temperature is raised under stirring, and then the components are subjected to a copolycondensation reaction at 160° C. for 7 hours, and after that, are heated up to 220° C. while being slowly reduced to 10 Torr, and are maintained for 4 hours. Then, when the pressure is released to the normal pressure, 9 parts of trimellitic anhydride is added to the components, and the components are slowly reduced again to 10 Torr again and are maintained at 220° C. for 1 hour, and thus an amorphous polyester resin is synthesized.

(Preparation of Amorphous Polyester Resin Dispersion)

Amorphous polyester resin: 160 parts

Ethyl acetate: 233 parts

Aqueous sodium hydroxide solution (0.3 N): 0.1 parts

The components described above are put into a 1000-ml separable flask, are heated at 70° C., and are stirred by a three-one motor (manufactured by Shinto Scientific Co., Ltd.), and thus a resin mixed solution is prepared. 373 parts of ion exchange water is slowly added to the resin mixed solution while being further stirred, and the resin mixed solution is subjected to phase inversion emulsification to be desolvated, and thus an amorphous polyester resin dispersion (a solid content concentration: 30%) is obtained.

(Synthesis of Crystalline Polyester Resin)

1,10-Dodecanedioic acid: 50 mol %

1,9-Nonane diol: 50 mol %

The monomer components described above are put into a reaction container provided with a stirring device, a thermometer, a condenser, and a nitrogen gas introduction tube, and the inside air of the reaction container is substituted by dried nitrogen gas, and then 0.25 parts of titanium tetrabutoxide (a reagent) is put thereinto with respect to 100 parts of the monomer component. A stirring reaction is performed at 170° C. for 3 hours in a nitrogen gas flow, and then the temperature further is increased up to 210° C. over 1 hour, the inside of the reaction container is reduced to 3 kPa, and the reaction is performed with stirring for 13 hours under reduced pressure, and thus a crystalline polyester resin is obtained.

(Preparation of Crystalline Polyester Resin Dispersion)

300 parts of the crystalline polyester resin, 160 parts of methyl ethyl ketone (a solvent), and 100 parts of isopropyl alcohol (a solvent) are put into a 3-liter jacket-attached reaction vessel (manufactured by Tokyo Rikakikai Co., Ltd.: BJ-30N) provided with a condenser, a thermometer, a water dropping device, and a stirring unit having an anchor blade, and are stirred and mixed at 100 rpm while being maintained in a water circulating constant temperature vessel at 70° C., and thus the resin is dissolved.

After that, the speed of a stirring rotation is set to 150 rpm and the temperature of the water circulating constant temperature vessel is set to 66° C., 17 parts of 10% ammonia water (a reagent) is put thereinto over 10 minutes, and then 900 parts of ion exchange water in total which has been maintained at 66° C. is dripped at a rate of 7 parts/minute to perform phase inversion, and thus an emulsified liquid is obtained.

Shortly after, 800 parts of the obtained emulsification liquid and 700 parts of ion exchange water are put into a 2-liter eggplant flask, and are set in an evaporator (manufactured by Tokyo Rikakikai Co., Ltd.) provided with a vacuum control unit through a trap sphere. The eggplant flask is heated in a hot bath of 60° C. while being rotated, and is reduced to 7 kPa while paying attention to bumping, and thus the solvent is removed. When a solvent collection amount is 1100 parts, the pressure is released to the normal pressure, the eggplant flask is cooled by water, and thus a dispersion is obtained. There is no solvent odor in the obtained dispersion. The volume average particle diameter D50v of the resin particles in the dispersion is 130 nm. After that, the solid content concentration is adjusted to be 20% by adding ion exchange water, and thus a crystalline polyester resin dispersion is obtained.

(Preparation of Brilliant Pigment Dispersion)

Aluminum pigment (manufactured by Showa Aluminum Powder Corporation, 2173EA, 6 μm): 100 parts Anionic surfactant (manufactured by Dai-ichi Kogyo Seiyaku Co., Ltd., NEOGEN R): 1.5 parts Ion exchange water: 400 parts A solvent is removed from a paste of an aluminum pigment, the pigment is mechanically ground to 5.2 μm by using a star mill (manufactured by Ashizawa Finetech Ltd., LMZ), and is classified. After that, the pigment described above is mixed with the surfactant and ion exchange water, and the obtained mixture is dispersed for approximately 1 hour by using an emulsification disperser CAVITRON (manufactured by Pacific Machinery & Engineering Co., Ltd., CR1010), and thus a brilliant pigment dispersion is prepared (a solid content concentration: 20%) in which brilliant pigment particles (the aluminum pigment) are dispersed. A pigment dispersion diameter is 5.2 μm.

(Preparation of Yellow Coloring Agent Dispersion)

C.I. Pigment Yellow 74 (a monoazo pigment, manufactured by Dainichiseika Color & Chemicals Mfg. Co., Ltd., Seika fast yellow 2054): 50 parts Ionic surfactant NEOGEN RK (manufactured by Dai-ichi Kogyo Seiyaku Co., Ltd.): 5 parts Ion exchange water: 192.9 parts The components described above are mixed, and are processed at 240 MPa for 10 minutes by an ultimizer (manufactured by Sugino Machine Limited.), and thus a yellow coloring agent dispersion 1 is obtained. A solid content concentration is 20%.

(Preparation of Release Agent Dispersion)

Carnauba wax (manufactured by Toakasei Co., Ltd., RC-160): 50 parts

Anionic surfactant (manufactured by Dai-ichi Kogyo Seiyaku Co., Ltd., NEOGEN RK): 1.0 part Ion exchange water: 200 parts The components described above are mixed and are heated at 95° C., are dispersed by using a homogenizer (manufactured by IKA Ltd., ULTRA TURRAX T50), and then are subjected to a dispersion treatment for 360 minutes by using a Manton Gaulin high-pressure homogenizer (manufactured by Gaulin Co., Ltd.), and thus a release agent dispersion (a solid content concentration: 20%) is prepared in which release agent particles having a volume average particle diameter of 0.23 μm are dispersed.

Manufacturing of Brilliant Silver Toner 1

Brilliant pigment dispersion: 150 parts

Amorphous polyester resin dispersion: 200 parts

Crystalline polyester resin dispersion: 90 parts

Release agent dispersion: 50 parts

The components described above are put into a 2-L cylindrical stainless steel container, and are dispersed and mixed at 4000 rpm for 10 minutes by using a homogenizer (manufactured by IKA Ltd., ULTRA TURRAX T50) while applying a shear force. Next, 1.75 parts of 10% nitric acid aqueous solution of polyaluminum chloride is slowly dropped as the aggregating agent, and is dispersed and mixed for 15 minutes by setting the rotation speed of the homogenizer to 5000 rpm, and thus a raw material dispersion is obtained.

After that, the dispersion is transported to a polymerization tank provided with a stirring device using four paddles of stirring blades for forming a laminar flow, and a thermometer, and starts to be heated by a mantle heater after setting the speed of stirring rotation to 1000 rpm, and the growth of aggregated particles is promoted at 54° C. In addition, at this time, the pH of the dispersion is adjusted to be in a range of 2.2 to 3.5 with 0.3 N nitric acid and 1 N sodium hydroxide aqueous solution. The dispersion is maintained for approximately 2 hours within the pH range to thereby form aggregated particles.

Next, 70 parts of the amorphous polyester resin dispersion is further added, and thus amorphous polyester resin particles are attached onto the surface of the aggregated particles. Further, the temperature is increased up to 56° C., and the aggregated particles are adjusted while confirming the size and the shape of the particles by an optical microscope and MULTISIZER II. After that, 3.25 parts of a chelating agent (HIDS, manufactured by Nippon Shokubai Co., Ltd.) is added, and then the pH is adjusted to be 7.8 by using a 5% aqueous sodium hydroxide solution, and the resultant is maintained for 15 minutes. After that, the pH is increased to 8.0 in order to make the aggregated particles coalesce, and then the temperature is increased up to 67.5° C. After it is confirmed that the aggregated particles coalesce by the optical microscope, the pH is decreased up to 6.0 while maintaining the temperature at 67.5° C., and the heating is stopped after 1 hour, and then cooling is performed at a rate of a temperature decrease of 1.0° C./minute. After that, the aggregated particles are sieved by a mesh of 40 μm, are repeatedly subjected to water washing, and then are dried by a vacuum drying machine, and thus toner particles are obtained. The volume average particle diameter of the obtained toner particles is 11.5 μm.

1.5 parts of colloidal silica (manufactured by Japan Aerosil Corporation, R972) is mixed with respect to 100 parts of the obtained toner particles at a circumferential velocity of 30 m/s for 2 minutes by a HENSCHEL mixer, and thus a brilliant silver toner 1 is obtained.

Manufacturing of Brilliant Silver Toner 2

A brilliant silver toner 2 is obtained by the same operation as that in the manufacturing of the brilliant silver toner 1 except that the amount of the release agent dispersion is changed to 46 parts and the amount of the crystalline polyester resin dispersion is changed to 32 parts, in the manufacturing of the brilliant silver toner 1.

Manufacturing of Brilliant Silver Toner 3

A brilliant silver toner 3 is obtained by the same operation as that in the manufacturing of the brilliant silver toner 1 except that the amount of the release agent dispersion is changed to 46 parts and the amount of the crystalline polyester resin dispersion is changed to 36 parts, in the manufacturing of the brilliant silver toner 1.

Manufacturing of Brilliant Silver Toner 4

A brilliant silver toner 4 is obtained by the same operation as that in the manufacturing of the brilliant silver toner 1 except that the amount of the release agent dispersion is changed to 53 parts and the amount of the crystalline polyester resin dispersion is changed to 132 parts, in the manufacturing of the brilliant silver toner 1.

Manufacturing of Brilliant Silver Toner 5

A brilliant silver toner 5 is obtained by the same operation as that in the manufacturing of the brilliant silver toner 1 except that the amount of the release agent dispersion is changed to 44 parts and the amount of the crystalline polyester resin dispersion is changed to 15 parts, in the manufacturing of the brilliant silver toner 1.

Manufacturing of Brilliant Silver Toner 6

A brilliant silver toner 6 is obtained by the same operation as that in the manufacturing of the brilliant silver toner 1 except that the amount of the release agent dispersion is changed to 56 parts and the amount of the crystalline polyester resin dispersion is changed to 179 parts, in the manufacturing of the brilliant silver toner 1.

Manufacturing of Yellow Toner 1

Yellow coloring agent dispersion: 50 parts

Amorphous polyester resin dispersion: 300 parts

Crystalline polyester resin dispersion: 13 parts

Release agent dispersion: 48 parts

The components described above are put into a 2-L cylindrical stainless steel container, and are dispersed and mixed at 4000 rpm for 10 minutes by using a homogenizer (manufactured by IKA Ltd., ULTRA TURRAX T50) while applying a shear force. Next, 1.75 parts of 10% nitric acid aqueous solution of polyaluminum chloride is slowly dropped as the aggregating agent, and is dispersed and mixed for 15 minutes after setting the rotation speed of the homogenizer to 5000 rpm, and thus a raw material dispersion is obtained.

After that, the raw material dispersion is transported to a polymerization tank provided with a stirring unit using four paddles of stirring blades, and a thermometer, and heating is started with a mantle heater after setting the speed of stirring rotation to 600 rpm, and the growth of aggregated particles is promoted at 50° C. In addition, at this time, the pH of the dispersion is adjusted to be in a range of 2.2 to 3.5 with 0.3 N nitric acid and 1 N sodium hydroxide aqueous solution. The dispersion is maintained for approximately 2 hours within the pH range, and aggregated particles are formed.

Next, 70 parts of the amorphous polyester resin dispersion is further added, and thus amorphous polyester resin particles are attached onto the surface of the aggregated particles. Further, the temperature is increased to 52° C., and the aggregated particles are adjusted while confirming the size and the shape of the particles by an optical microscope and MULTISIZER II. After that, 2.25 parts of a chelating agent (HIDS, manufactured by Nippon Shokubai Co., Ltd.) is added, and then the pH is adjusted to be 7.8 by using a 5% sodium hydroxide aqueous solution, and the resultant is maintained for 15 minutes. After that, the pH is increased to 8.0 and then the temperature is increased up to 67.5° C. in order to make the aggregated particles coalesce. After it is confirmed that the aggregated particles coalesce by the optical microscope, the pH is increased to 6.0 while maintaining the temperature at 67.5° C., and the heating is stopped after 1 hour, and then cooling is performed at a rate of temperature decrease of 1.0° C./minute. After that, the aggregated particles are sieved by a mesh of 20 μm, are repeatedly subjected to water washing, and then are dried by a vacuum drying machine, and thus toner particles are obtained. The volume average particle diameter of the obtained toner particles is 5.5 μm.

1.5 parts of colloidal silica (manufactured by Japan Aerosil Corporation, R972) is mixed with respect to 100 parts of the obtained toner particles at a circumferential velocity of 30 m/s for 2 minutes by a HENSCHEL mixer, and thus a yellow toner 1 is obtained.

Manufacturing of Yellow Toner 2

A yellow toner 2 is obtained by the same operation as that in the manufacturing of the yellow toner 1 except that the amount of the crystalline polyester resin dispersion is changed to 16 parts, in the manufacturing of the yellow toner 1.

Manufacturing of Yellow Toner 3

A yellow toner 3 is obtained by the same operation as that in the manufacturing of the yellow toner 1 except that the amount of the crystalline polyester resin dispersion is changed to 11 parts, in the manufacturing of the yellow toner 1.

Manufacturing of Yellow Toner 4

A yellow toner 4 is obtained by the same operation as that in the manufacturing of the yellow toner 1 except that the amount of the crystalline polyester resin dispersion is changed to 17 parts, in the manufacturing of the yellow toner 1.

Manufacturing of Yellow Toner 5

A yellow toner 5 is obtained by the same operation as that in the manufacturing of the yellow toner 1 except that the amount of the release agent dispersion is changed to 50 parts and the amount of the crystalline polyester resin dispersion is changed to 41 parts, in the manufacturing of the yellow toner 1.

Manufacturing of Carrier

Ferrite particles (a volume average particle diameter: 35 μm): 100 parts

Toluene: 14 parts

Perfluorooctyl ethyl acrylate-methyl methacrylate copolymer (a critical surface tension: 24 dyn/cm, a copolymerization ratio of 2:8, and a weight average molecular weight of 77000): 1.6 parts Carbon black (a trade name: VXC-72, manufactured by Cabot Corporation, volume resistivity: less than or equal to 100 Ωcm): 0.12 parts Cross-linking melamine resin particles (an average particle diameter: 0.3 μm, toluene-insoluble): 0.3 parts First, the carbon black diluted with the toluene is added to the perfluorooctyl ethyl acrylate-methyl methacrylate copolymer, and is dispersed by a sand mill. Next, the components described above other than the ferrite particles are dispersed therein for 10 minutes by a stirrer, and thus a covering layer forming solution is prepared. Next, the covering layer forming solution and the ferrite particles are put into a vacuum degassing kneader, are stirred at a temperature of 60° C. for 30 minutes, and then the toluene is distilled away by being reduced, and thus a resin coating layer is formed, and a carrier is obtained.

Preparation of Developer

With respect to the brilliant silver toners 1 to 6 and the yellow toners 1 to 5, respectively, 36 parts of the toner and 414 parts of the carrier are put into a V blender, are stirred for 20 minutes, and after that, are sieved by 212 μm, and thus a developer is prepared.

Evaluation

—Measurement of Endothermic Quantity—

A differential scanning calorimeter [manufactured by Mac Science Corporation: DSC3110, a thermal analysis system 001] is used in the measurement, a melting temperature of a mixture of indium and zinc is used for a temperature correction of the detecting unit of the device, and melting heat of indium is used for a correction of a heat quantity. A sample (the toner) is put into an aluminum pan, the aluminum pan into which the sample is put and an empty aluminum pan for comparison are set, and the measurement is performed at a rate of temperature increase of 10° C./min. The endothermic quantity is calculated from an endothermic portion of a DSC curve obtained by the measurement.

Results of the endothermic quantity in the brilliant toners 1 to 6 and the yellow toners 1 to 5 are shown in Table 1.

TABLE 1

| | Endothermic Quantity (mJ/g) |
|---|---|
| Brilliant Silver Toner 1 | 219 |
| Brilliant Silver Toner 2 | 161 |
| Brilliant Silver Toner 3 | 170 |
| Brilliant Silver Toner 4 | 280 |
| Brilliant Silver Toner 5 | 130 |
| Brilliant Silver Toner 6 | 378 |
| Yellow Toner 1 | 81 |
| Yellow Toner 2 | 107 |
| Yellow Toner 3 | 70 |
| Yellow Toner 4 | 130 |
| Yellow Toner 5 | 185 |

—Gloss Unevenness Evaluation—

A developing machine of Color 1000 Press manufactured by Fuji Xerox Co., Ltd. is filled with the developer, and a solid image in which the amount of brilliant silver toner applied is 4.0 g/m$^2$ and the amount of yellow toner applied is 4.0 g/m$^2$ is formed on coat paper (OK topcoat+paper, surface roughness Rz=1.98 μm, manufactured by Oji Paper Co., Ltd.) at a fixing temperature of 180° C. (a pressure roll temperature of 100° C.)

The gloss of the solid image is measured by using a glossmeter GM-26D (manufactured by Murakami Color Research Laboratory Co., Ltd.) under the condition in which an incident light angle with respect to the image is 75 degrees. A measurement portion of The gloss is measured at nine portions, which are intersections of three lines, which are in parallel with a lateral direction of the coat paper and located 5 cm, 15 cm, and 25 cm from one end portion of the coat paper in a longitudinal direction, and three lines, which are in parallel with the longitudinal direction of the coat paper and located 4 cm, 10.5 cm, and 17 cm from one end portion of the coat paper in the lateral direction and are orthogonal to the foregoing three lines. A difference Δ between the maximum value and the minimum value of the gloss is obtained. The gloss unevenness decreases as Δ becomes smaller. More specifically, it is most preferable that Δ is less than 1.0, when Δ is greater than or equal to 1.0 and less than 1.5, the gloss unevenness is observed through detailed observation, when Δ is greater than or equal to 1.5 and less than 2.0, the gloss unevenness is negligible, when Δ is greater than or equal to 2.0 and less than 3.0, the gloss unevenness is slightly noticeable, when Δ is greater than or equal to 3.0 and less than 4.0, the gloss unevenness is in a compromisable level, and when Δ is greater than or equal to 4.0, the gloss unevenness is uncompromisable.

The obtained results are shown in Table 2.

TABLE 2

| | Brilliant Silver Toner | Yellow Toner | Ratio of Endothermic Quantity | Evaluation Gloss Unevenness |
|---|---|---|---|---|
| Example 1 | 1 | 1 | 2.70 | 0.9 |
| Example 2 | 1 | 2 | 2.05 | 1.4 |
| Example 3 | 1 | 3 | 3.13 | 1.3 |
| Example 4 | 1 | 4 | 1.68 | 2.6 |
| Comparative Example 1 | 1 | 5 | 1.18 | 4.1 |
| Example 5 | 2 | 1 | 1.99 | 1.8 |
| Example 6 | 2 | 2 | 1.50 | 1.9 |
| Example 7 | 2 | 3 | 2.30 | 2.1 |
| Example 8 | 2 | 4 | 1.24 | 3.8 |
| Comparative Example 2 | 2 | 5 | 0.87 | 5.3 |
| Example 9 | 3 | 1 | 2.10 | 1.4 |
| Example 10 | 3 | 2 | 1.59 | 1.8 |
| Example 11 | 3 | 3 | 2.43 | 2.2 |
| Example 12 | 3 | 4 | 1.31 | 3.7 |
| Comparative Example 3 | 3 | 5 | 0.92 | 5.1 |
| Example 13 | 4 | 1 | 3.46 | 1.3 |
| Example 14 | 4 | 2 | 2.62 | 1.6 |
| Example 15 | 4 | 3 | 4.00 | 2.1 |
| Example 16 | 4 | 4 | 2.15 | 1.9 |
| Example 17 | 4 | 5 | 1.51 | 2.7 |
| Example 18 | 5 | 1 | 1.60 | 2.9 |
| Example 19 | 5 | 2 | 1.21 | 3.9 |
| Example 20 | 5 | 3 | 1.86 | 2.9 |
| Comparative Example 4 | 5 | 4 | 1.00 | 4.5 |
| Comparative Example 5 | 5 | 5 | 0.70 | 6 |
| Example 21 | 6 | 1 | 4.67 | 3.3 |
| Example 22 | 6 | 2 | 3.53 | 2.8 |
| Comparative Example 6 | 6 | 3 | 5.40 | 6 |
| Example 23 | 6 | 4 | 2.91 | 1.8 |
| Example 24 | 6 | 5 | 2.04 | 1.7 |

From Table 2, it can be seen that when a difference in the endothermic quantities is in a range of this exemplary embodiment, the gloss unevenness is decreased, and thus a preferable image is obtained. In contrast, when the endothermic quantity falls outside the range of this exemplary embodiment, the gloss unevenness is increased, and hot offset tends to easily occur.

The foregoing description of the exemplary embodiments of the present invention has been provided for the purposes of illustration and description. It is not intended to be exhaustive or to limit the invention to the precise forms disclosed. Obviously, many modifications and variations will be apparent to practitioners skilled in the art. The embodiments were chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. A toner set comprising:

a brilliant toner including a brilliant pigment; and a chromatic toner including a coloring agent that is different from the brilliant pigment, and the toner set satisfies the following expression:

$$1.2 \leq Q1/Q2 \leq 5.0$$

wherein Q1 represents an endothermic quantity of the brilliant toner, and Q2 represents an endothermic quantity of the chromatic toner.

2. The toner set according to claim 1, wherein the brilliant toner contains a crystalline resin, and a content ratio of the crystalline resin in the brilliant toner is from 3% by weight to 20% by weight.

3. The toner set according to claim 1, wherein the chromatic toner is at least one selected from the group consisting of a cyan toner, a magenta toner, and a yellow toner.

4. The toner set according to claim 1, wherein the chromatic toner is a black toner.

5. The toner set according to claim 1, wherein the brilliant toner satisfies the following expression when a solid image is formed, $$2 \leq A/B \leq 100$$

wherein A represents reflectance at a light receiving angle of +30° that is measured at the time of irradiating the image with incident light having an incident angle of −45° by a goniophotometer, and B represents reflectance at a light receiving angle of −30°.

6. The toner set according to claim 1, wherein the brilliant toner contains toner particles having a flake shape, and an average equivalent circle diameter D of the toner particles is greater than an average thickness C of the toner particles.

7. The toner set according to claim 6, wherein a ratio (C/D) of the average thickness C of the toner particles to the average equivalent circle diameter D of the toner particles is in a range of 0.001 to 0.200.

8. The toner set according to claim 1, wherein a ratio (Q1/Q2) of the endothermic quantity is in a range of 2.0 to 3.5.

9. An image forming method comprising:

forming a brilliant toner image by using a brilliant toner including a brilliant pigment;

forming a chromatic toner image by using a chromatic toner including a coloring agent;

transferring the brilliant toner image and the chromatic toner image onto a recording medium; and fixing the brilliant toner image and the chromatic toner image onto the recording medium, and the brilliant toner and the chromatic toner satisfy the following expression:

$$1.2 \leq Q1/Q2 \leq 5.0$$

wherein Q1 represents an endothermic quantity of the brilliant toner, and Q2 represents an endothermic quantity of the chromatic toner.

10. The image forming method according to claim 9, wherein the brilliant toner contains a crystalline resin, and a content ratio of the crystalline resin in the brilliant toner is from 3% by weight to 20% by weight.

11. The image forming method according to claim 9, wherein a ratio (Q1/Q2) of the endothermic quantity is in a range of 2.0 to 3.5.

* * * * *